United States Patent [19]

Glorstad

[11] Patent Number: 5,051,035

[45] Date of Patent: Sep. 24, 1991

[54] BEARING SYSTEM FOR A TURNING MEANS

[75] Inventor: Torbjorn Glorstad, Fillan, Norway

[73] Assignee: Golar-Nor Offshore A/S, Trondheim, Norway

[21] Appl. No.: 528,014

[22] Filed: May 23, 1990

[30] Foreign Application Priority Data

May 24, 1989 [NO] Norway ..... 892078

[51] Int. Cl.[5] ..... B63B 35/44

[52] U.S. Cl. ..... 405/195; 114/264; 175/7; 405/201

[58] Field of Search ..... 405/195, 196, 201, 224; 108/139, 141; 114/264, 265; 175/5, 7; 248/349

[56] References Cited

U.S. PATENT DOCUMENTS

| | | | |
|---|---|---|---|
| 1,128,039 | 2/1915 | Piercy | 405/201 |
| 2,628,818 | 2/1953 | Graham | 405/201 X |
| 3,397,411 | 8/1968 | Rossi | 108/141 |
| 3,602,175 | 8/1971 | Morgan | 175/7 X |
| 3,762,275 | 10/1973 | Imamura | 248/349 X |
| 4,571,125 | 2/1986 | Oshima et al. | 405/224 |
| 4,698,038 | 10/1987 | Key et al. . | |
| 4,701,143 | 10/1987 | Key et al. . | |
| 4,753,553 | 6/1988 | Carlsen et al. . | |
| 4,753,553 | 6/1988 | Carlsen et al. | 405/195 |

*Primary Examiner*—David H. Corbin

*Attorney, Agent, or Firm*—Dykema Gossett

[57] ABSTRACT

A device for supporting a turntable (1) on a vessel, especially a vessel for use in connection with drilling for and production of oil, which vessel is anchored to the sea floor, via the turntable (1). The turntable (1) comprises a horizontal circular flange portion (2) and a cylindrical portion (3) extending coaxially relative to the latter and downwards from the flange portion (2) into a vertical through hole (7) in the hull (6). Said device comprises bearing means (21, 22, 23, 24) which are connected with the vessel's hull (6) and comprise one or a plurality of bearing members (31, 34, 41, 46) adapted to bear against the respective bearing faces (11, 12, 13, 14) of the turntable flange portion (2). The bearing means permit relative rotation of the turntable (1) and the hull (6) about a substantially vertical axis. According to the invention first and second bearing means (21 and 22, respectively) are provided beneath the peripheral portion of the turntable flange and are designed to support turntable (1). The bearing member or members of the second bearing means are raisable and lowerable, so that the turntable (1) can be moved in a vertical direction between a first lowered position and a second raised position. In the first position, the turntable (1) is carried only by the first bearing means (21), and in the second position the turntable (1) is carried only by the second bearing means (22).

10 Claims, 3 Drawing Sheets

BEARING SYSTEM FOR A TURNING MEANS

The invention relates to a device for mounting a turntable or turning body on a vessel, especially a vessel for use in connecting with drilling for and production of oil, said vessel being anchored to the sea floor, via said turntable, and the turntable comprising a horizontally extending, circular flange portion, and a cylindrical portion extending coaxially relative to the latter and downwards from said flange portion into a vertically extending through hole in the hull, the device comprising bearing means which are connected with the hull of the vessel and comprise one or a plurality of bearing members adapted for contact with respective bearing faces of the turntable flange portion, and said bearing means and faces permitting mutual rotation of the turntable and the vessel about a substantially vertical axis.

Mounting means of a kind similar to the above mentioned are previously known and comprise a bearing means which is provided below the flange portion of a turntable, and a bearing means provided radially outside the latter. Furthermore, turntables are known, where a bearing means with bearing members adapted for contact with an associated bearing face of the cylindrical portion of the turntable is mounted in the through hole and on the portion of the hull which is submerged in water. The bearing means below the flange portion of the turntable carries the turntable and prevents vertical movement downwards of turntable, and the bearing means positioned radially outside the flange portion of cylindrical portion, respectively, of the turntable, prevents horizontal motion and tilting of the latter about horizontal axes. In this case the weight of the turntable and the force of anchoring cables exerted against the turntable are to prevent any upwards directed vertical movement of the turntable.

For repair or maintenance of the bearing means provided immediately below the flange portion of the turntable, the turntable must be raised and any running drilling or production operations must be interrupted. It may also be necessary to remove the turntable completely from the hole in order to carry out such work in connection with the bearing means or bearing surface in the submerged portion of the through hole in the hull.

If the vessel floats on the water divers may be required to carry out desired operations in connection with the bearing faces.

It is an object of the invention to provide a bearing means of the kind mentioned above, which is not burdened with the above disadvantages.

The characteristics of the invention will appear from the characterizing features stated in the claims.

The invention is disclosed in more detail below with reference to the drawing which shows a diagrammatical embodiment of a bearing means according to the invention.

Figure 1:
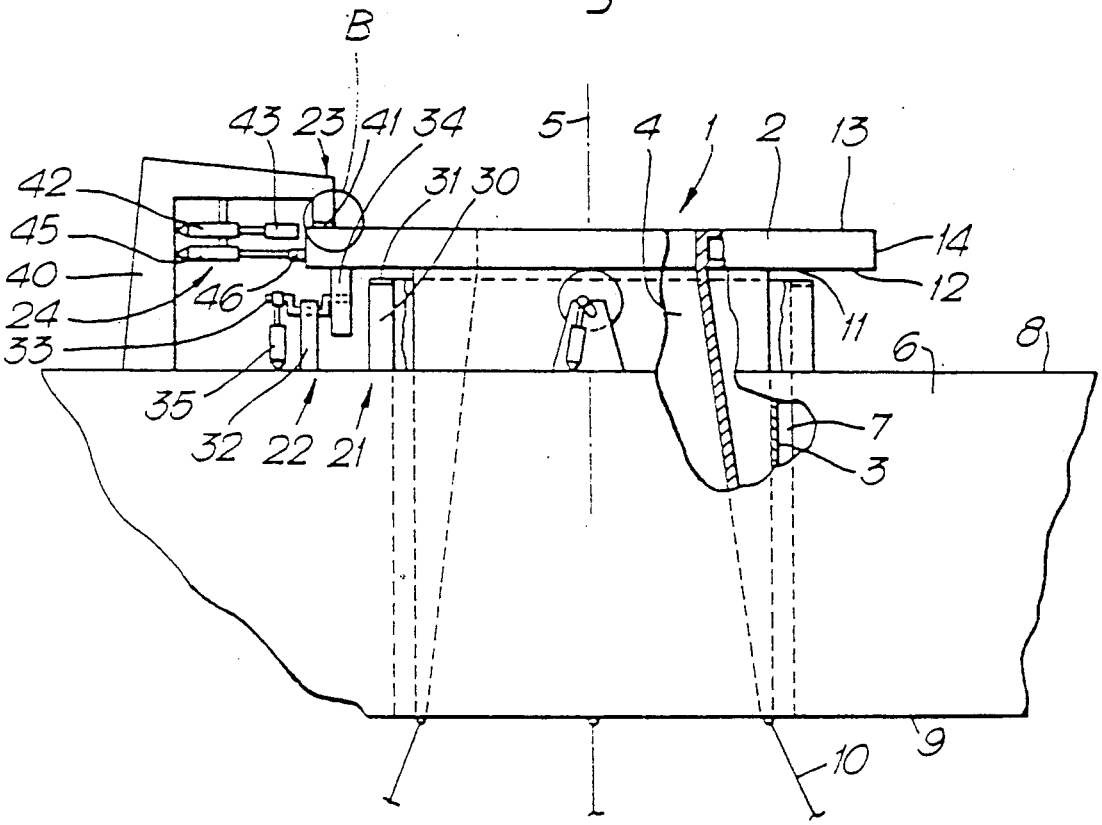
FIG. 1 is an elevational view, partly in section, of a vessel's hull with a mounting means according to the invention.
Figure 2:
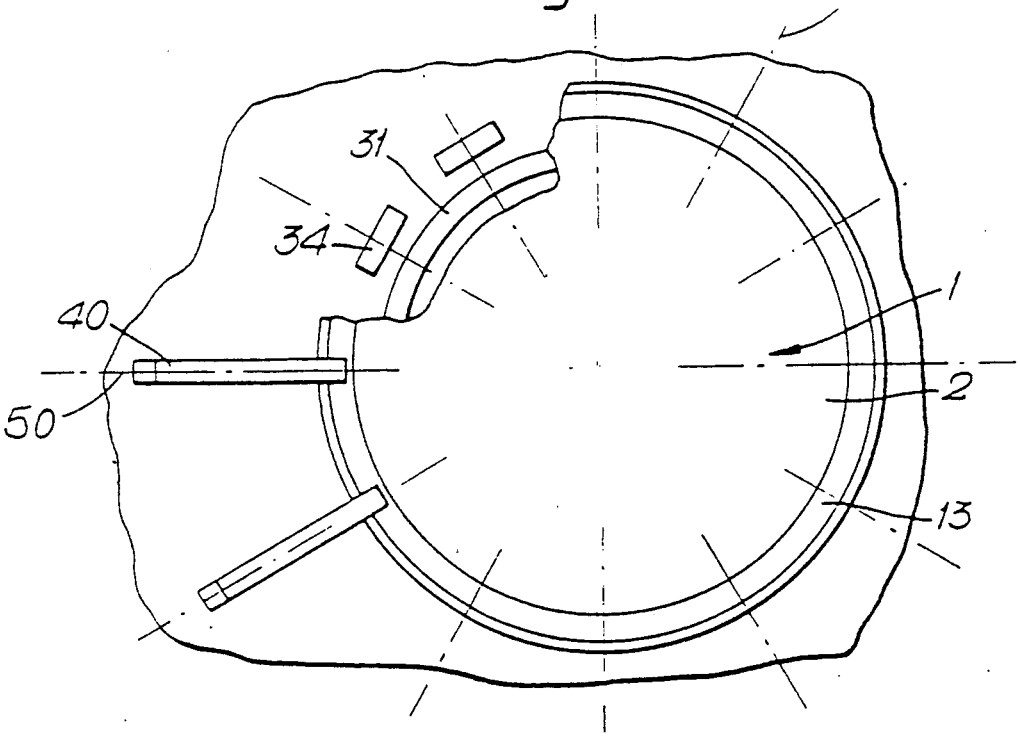
FIG. 2 is a plan view of the hull portion shown in FIG. 1, with a portion of the turntable removed, showing only some of the bearing means.

As shown in FIG. 1 a vertically extending through hole 7 with a circular cross section is provided in the hull 6 of a vessel with a deck 8 and a bottom 9.

A turntable 1 comprising a cylindrical portion 3 and a circular flange portion 2 which is firmly connected with the upper end portion of said cylindrical portion is provided in hole 7.

Furthermore, turntable 1 comprises a through hole 4 extending coaxially with cylindrical portion 3.

The diameter of the hole 7 is larger than the external diameter of the cylindrical portion 3 of the turntable, but smaller than the external diameter of flange portion 2, and the length of cylindrical portion 3 is larger than the distance between the deck 8 and the bottom 9 of the vessel.

The turntable is provided to be substantially coaxial in the hole 7, its lower portion being level with the bottom 9 of the vessel and, via cables 10, being connected with anchors not shown. The flange portion, thus, extends in parallel with the deck 8 and radially outwards from the edge of the hole 7.

Flange portion 2 has a first or inner, and a second or outer annular bearing face or race 11, and 12, resp. on its underside, and a third annular bearing face or race 13 on its upper side, these bearing faces extending in planes normal to the longitudinal axis 5 of the turntable. Along its periphery flange portion 2, furthermore, has a radially outwards facing fourth bearing face or race 14, like the remaining bearing faces extending coaxially with longitudinal axis 5 of the turntable.

On the deck, immediately above the bearing faces 11, 12, 13, 14 first, second, third, and fourth bearing means 21, 22, 23, and 24, respectively, are mounted to be in contact with the associated bearing faces with low friction. The first and second bearing means 21, and 22, respectively, which are provided below the flange portion 2 of the turntable, are designed to support the turntable. The third bearing means which is provided above the turntable is designed to prevent any essential vertical movement upwards of the turntable, and the fourth bearing means which is provided radially outside the flange portion of the turntable, is provided to prevent essential horizontal movement of the turntable relative to the vessel's hull.

The first bearing means comprises a vertically extending hollow cylindric bracket 30, the lower end portion of which is attached to the deck 8 radially outside the hole 7 in the hull 6, and is concentric with and immediately outside said hole. A slider means or segment 31 showing good sliding properties is attached to upper portion of bracket 30.

The second bearing means comprises a number of bearing pedestals 32 which are provided equally spaced along a circle radially outside bracket 30.

Figure 3:
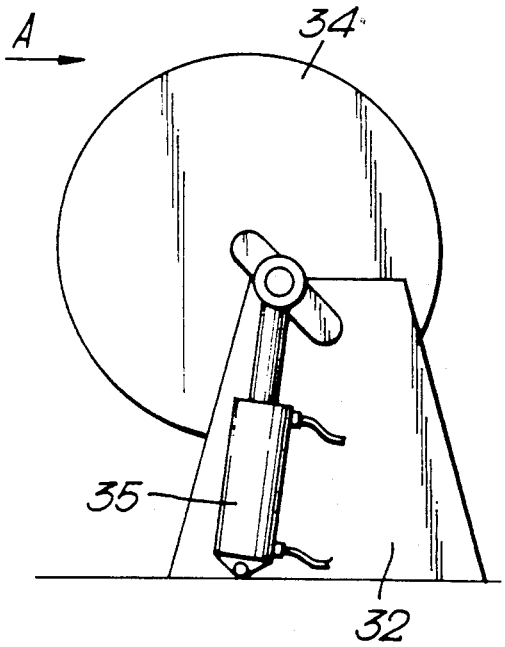
FIG. 3 is an elevational view of a bearing means.
Figure 4:
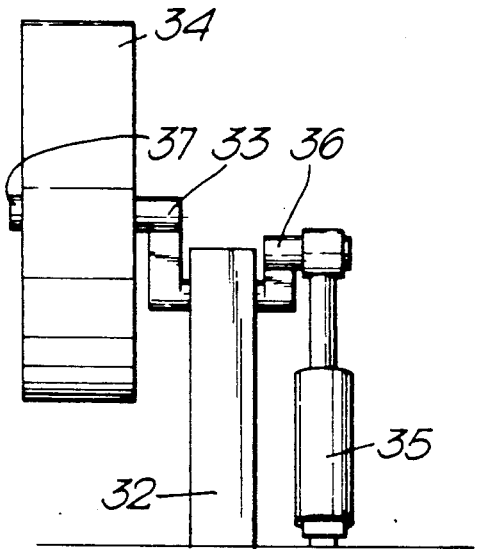
FIG. 4 is a view of the bearing means shown in FIG. 3, as seen in the direction of arrow A.

As shown in FIGS. 3 and 4, a crank-like shaft 33 is mounted in each bearing pedestal 32. On each side of a central portion, which is mounted in bearing pedestal 30, said shaft has an elongation or shaft journal 36, 37, the longitudinal axis of which extends in parallel with, but is not coaxial with said central portion. On one shaft journal 37 a roller or wheel 34 is rotatably mounted, and the second shaft journal 36 is directly connected with the outer end portion of the piston rod of a hydraulic cylinder 35, the cylinder portion of which is articulated to the deck 8.

The longitudinal axis of the portions of shaft 33 extends radially relative to the longitudinal axis of hole 7, so that rollers 34 may be activated to roll along the second bearing face 12.

By actuating hydraulic cylinder 35 to retract the plunger means into the cylinder means, roller 34 will, thus, be lowered, and vice versa. When rollers 34 are lowered the distance between deck 8 and the top of rollers will be less than the distance between deck 8 and the top of slider means 31, and when rollers 34 are raised the distance between deck 8 and the top of rollers will be larger than the distance between deck 8 and the top of slider means 31. Movement of the turntable between a first lowered position and a second raised position is, thus, permitted. In the first position of the turntable it is carried by and may rotate only on the first bearing means 21, and in the second position it is carried by and may rotate only on the second bearing means 22.

Figure 5:
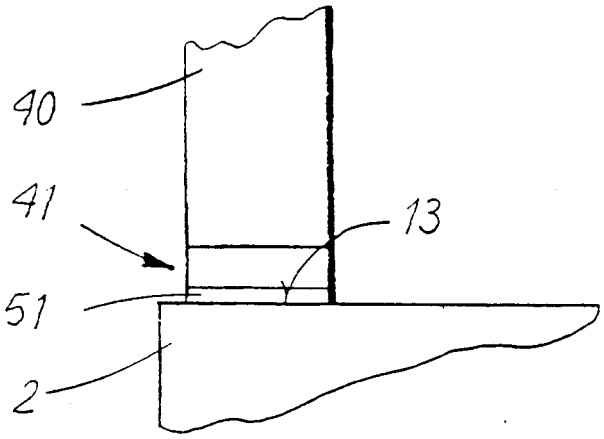
FIG. 5 is an enlarged view of portion "B" encircled in FIG. 1.

The third bearing means 23, like second bearing means 22, comprises a series of brackets 40 which may, e.g. be firmly connected with deck 8 radially outside bearing pedestals 32 at evenly spaced angular positions as indicated with the center lines 50. Brackets 40 extend in a yoke shape radially inwards and across flange portion 2 of the turntable, and they terminate in a portion projecting down towards third bearing face 13 of the turntable. A slider 41, the lower surface of which is covered by a material 51 with good sliding properties (as shown in FIG. 5), is here attached to bracket 40, in such a way that there is a slight clearance between slider and the associated third slide face 13 when the turntable is in its second raised position. Any possible tilting movement of the turntable about a horizontal axis will, thus, be limited corresponding to said slight clearance when the turntable is raised.

In order to restrict such a tilting movement to the same degree when the turntable is lowered, a hydraulic cylinder 42 is attached to each bracket and carries a block or spacer 43 to the lower side of which a slider means with good sliding property is secured. By the aid of the hydraulic cylinders the blocks 43 may be moved horizontally between a first position, in which they are present in the space between third bearing face 13 of turntable 1 and slider means 41 of bracket 40, and a second position in which they are radially outside flange portion 2 of the turntable.

The height of the blocks 43 corresponds to the vertical distance of displacement of turntable 1 when the latter is moved from its first to its second position by the aid of the second bearing means, and when the blocks are in said first position they preferably contact the respective slider means 41 of the bracket 40.

Radially outside the cylindric face of the flange portion 2 of the turntable a hydraulic cylinder 45 is attached to each bracket 40 and carries a slider means 46 which is adapted for contact with the fourth bearing face 14, and has good sliding properties. Before raising or lowering the turntable 1 the slider means 46 are moved radially away from the fourth bearing face 14 by the aid of the hydraulic cylinders 45, so that they do not block the turntable during the raising or lowering movement. After completed raising or lowering of the turntable, the slider means 46 are again moved radially inwards towards the fourth bearing face 14 of the turntable flange by the aid of the hydraulic cylinders 45.

The function of the support means is as follows, assuming that the turntable 1 initially is in its first, lowered position.

This position of the turntable is selected when the direction of wind is stable or the forces exerted by the turntable on second bearing means 22 are so large that there is a hazard of overloading the latter.

If the direction of the wind is expected to turn and there is no hazard of overloading, as mentioned above, the blocks 43 of the third bearing means 23 are removed from the space between the slider means 41 and the third bearing face 13 of the turning means. The rollers 34 of the second bearing means 22 are now raised, causing the turning means to be raised and the third bearing face 13 to be moved into a position where it is close to the underside of slider means 41 of the third bearing means. The ship's hull may in this connection be turned very easily relative to the turntable, so that the longitudinal axis of the ship will always coincide with the direction of the wind. In this position of the turntable maintenance and repair work may also be carried out in connection with the first bearing means or face.

If periods without any danger of change of the direction of wind should occur again, the rollers 34 of the second bearing means may be lowered, so that the sliders 31 of the first bearing means 21 may be made to contact the first bearing face 11, whereupon spacers or spacer blocks 43 are moved radially inwards, towards the longitudinal axis 5 of the turntable by the aid of the hydraulic cylinders 42, to cause the clearance between the third bearing face and the cooperating stationary bearing face to remain the same. In this position of the turntable the second bearing means is not subjected to wear, which is advantageous this device comprising the most expensive components. In this position of the turntable it is also possible to carry out maintenance and repair work in connection with the second bearing means. If a change of the direction of wind should occur meanwhile, the ship's hull can still turn due to the fact that first bearing face and cooperating slider 31 show good sliding properties. Even though the first, third, and fourth bearing means have sliders and the second bearing means has rollers, more than said second bearing means may, obviously, be provided with rollers or the second bearing means may also be provided with slider means in stead of rollers, provided that easy relative movability of hull and turning means is ensured. Furthermore, slider means 41 of the third bearing means may be raisable and lowerable by the aid of associated hydraulic cylinders, either by being provided, e.g. on the plunger member of the respective hydraulic cylinders, the stroke length of which corresponds to the displacement of the turntable, or by being provided on a crank means similar to the crank means of second bearing means. In the last mentioned case blocks 43 and hydraulic cylinders 42 are omitted.

I claim:

1. A device for use on a vessel of the type used for drilling oil, said vessel including both a hull (6) having a hole (7) therethrough and a turntable (1) of the type having a horizontally extending circular flange portion (2) and a cylinder portion (3) extending co-axially relative to said flange portion (2) and projecting downwards from said flange portion (2) into said hole (7), said device comprising bearing means (21, 22, 23, 24), connected to said hull (6) and to said flange portion (2), for permitting mutual rotation of said turntable (1) and said hull (6) about a vertical axis (5) and for supporting said turntable (1) such that said turntable (1) may be moved in a vertical direction between a first lowered position and a second raised position, said bearing means (21, 22, 23, 24) having a first bearing means (21) for solely and rotatably carrying said turntable (1) when said turntable (1) is in said first position and further having a second bearing means (22) for solely and rotatably carrying said turntable (1) when said turntable (1) is in said second position.

2. The device of claim 1 wherein said second bearing means (22) comprises a plurality of pedestals (32), coupled to said hull (6) and equidistantly spaced along the periphery of said flange portion (2), each of said pedestals (32) having a roller (34) rotatably mounted therein and adapted to bear against said flange portion (2).

3. The device of claim 2 wherein said bearing means (21, 22, 23, 24) includes a third bearing means (23) comprising a member (41), coupled to said hull (6), which is covered by a material (51) with good sliding properties.

4. The device of claim 3 wherein said first bearing means (21) comprises a race (31) continuously extending along the periphery of the flange portion (2) and manufactured from a material with good sliding properties.

5. The device of claim 4 wherein each of said plurality of pedestals (32) includes a horizontally extending shaft (33) rotatably coupled therein, said shaft (33) having an eccentric portion relative to its axis of rotation with said eccentric portion being coupled to a roller (34), said eccentric portion being effective to move said roller (34), with respect to said flange (2) in response to said rotation of said shaft (33).

6. The device of claim 3 wherein said third bearing means (23) is separated from said first bearing means (21) by a first distance when said turntable (1) is in said second position and wherein said third bearing means (23) is also separated from said second bearing means (22) by a second distance when said turntable (1) is in said second position, said third bearing means (23) being provided above said flange portion (2) to substantially prevent vertical upward movement of said turntable (1) and also having a movable bearing member means (41) for ensuring that said first and second distances remain constant when said turntable (1) is placed in said first position.

7. The device of claim 3 wherein said third bearing means (23) comprises a bearing member (43) and a horizontally extending shaft coupled to said bearing member (43) and adapted to move said bearing member (43) towards said flange portion (2).

8. The device of claim 3 wherein said member (41) and said turntable (1) co-operatively define a space therebetween, said third bearing means (23) further comprising a spacer means (43), movably coupled to said member (41), for movement between a first position in which said spacer means (43) substantially occupies said defined space thereby substantially preventing said turntable (1) from being raised and a second position in which said spacer means (43) is removed from said defined space.

9. The device of claim 1 further comprising fourth bearing means (24), coupled to said hull (6) and radially positioned from said flange portion (2), for substantially preventing horizontal movement of said turntable (1) from said hull (6).

10. The device of claim 9 wherein said fourth bearing means comprises a plurality of bearing members (46) which are provided along the periphery of said flange (2) and are movable between a first turntable contacting position and a second position in which said members (46) are moved a certain distance from said turntable.

* * * * *